US005280681A

United States Patent [19]

Diaw

[11] Patent Number: 5,280,681

[45] Date of Patent: Jan. 25, 1994

[54] IRONING DEVICE WITH PRESSURE APPLYING HINGED ARM

[75] Inventor: Ruly D. E. Diaw, Taichung, Taiwan

[73] Assignee: Sunbeen Precision Machine Inc., Taiwan

[21] Appl. No.: 3,162

[22] Filed: Jan. 12, 1993

[51] Int. Cl.[5] ..... D06F 71/12

[52] U.S. Cl. ..... 38/36

[58] Field of Search ..... 38/17, 27, 28, 32, 34, 38/36, 43, 37, 41; 100/223

[56] References Cited

U.S. PATENT DOCUMENTS

| | | | |
|---|---|---|---|
| 2,961,784 | 11/1960 | Foster | 38/28 |
| 3,757,440 | 9/1973 | Fresard et al. | 38/17 |
| 4,642,921 | 2/1987 | Primati | 38/36 |
| 4,998,360 | 3/1991 | Lee | 38/17 X |

FOREIGN PATENT DOCUMENTS

| | | | |
|---|---|---|---|
| 0102098 | 3/1984 | European Pat. Off. | 38/17 |
| 2605071 | 7/1977 | Fed. Rep. of Germany | 38/27 |

*Primary Examiner*—Clifford D. Crowder
*Assistant Examiner*—Ismael Izaguirre
*Attorney, Agent, or Firm*—Robbins, Berliner & Carson

[57] ABSTRACT

An ironing device includes a seat having a front portion and a rear portion, a base disposed on the rear portion of the seat, an arm pivotally coupled to the front portion of the seat, a board disposed on the rear portion of the arm and movable toward the base for pressing clothes. A bracket is pivotally coupled to the front portion of the arm, a spring is biased between the lower end of the bracket and the seat and exerts an upward force to the front portion of the arm when the lower end of the bracket is moved forward such that the board is forced against the base.

5 Claims, 4 Drawing Sheets

IRONING DEVICE WITH PRESSURE APPLYING HINGED ARM

BACKGROUND OF THE INVENTION

1. Field of the Invention

The present invention relates to an ironing device, and more particularly to an ironing device for hot-pressing the clothes.

2. Description of the Prior Art

Typical ironing devices include an ironing area which is very small such that the users have to move the ironing devices back and forth on the clothes in order to ironing the clothes. This is time consuming.

The present invention has arisen to mitigate and/or obviate the afore-described disadvantages of the conventional ironing devices.

SUMMARY OF THE INVENTION

The primary objective of the present invention is to provide an ironing device with which the clothes may be ironed in a fast speed.

In accordance with one aspect of the invention, there is provided an ironing device comprising a seat including a front portion having a shaft provided therein and a rear portion having a base provided thereon, an arm including a front portion pivotally coupled to the seat at the shaft and a rear portion having a board provided thereon and movable toward the base, a bracket including an upper end pivotally coupled to the front portion of the arm and including a middle portion and a lower end, means coupling the middle portion of the bracket to the handle, and means biased between the lower end of the bracket and the seat, the biasing means exerting an upward force to the front portion of the arm when the lower end of the bracket is moved forward by the handle via the coupling means, whereby, the board is forced against the base.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
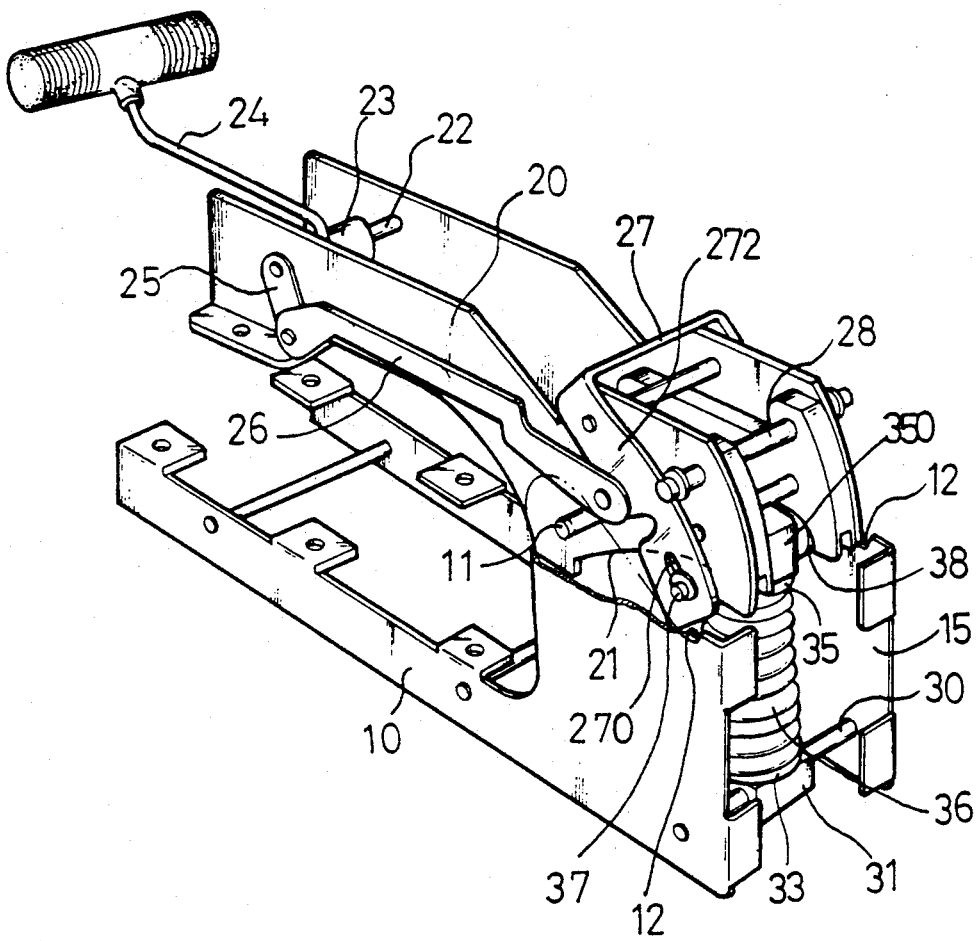
FIG. 1 is a perspective view of an ironing device in accordance with the present invention, in which several elements of the ironing device are removed.
Figure 2:
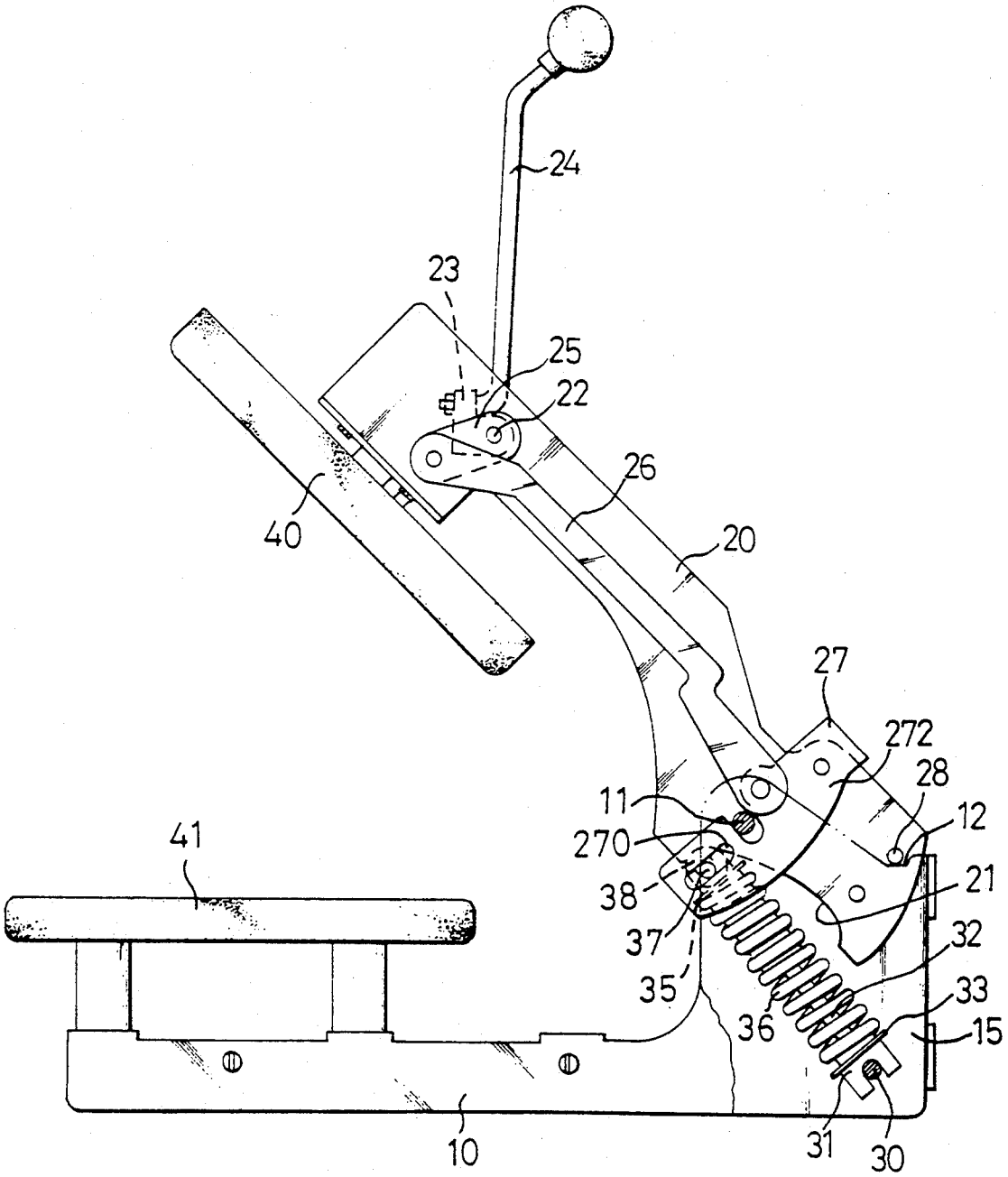
FIG. 2 is a plane view of the ironing device which is in an open position.

Referring to the drawings, and initially to FIGS. 1 and 2, an ironing device in accordance with the present invention comprises a seat 10 having a pair of lugs 15 provided on the front portion thereof and having a base 41 provided on the rear portion thereof, a shaft 11 disposed on the upper portion of the lugs 15, and a recess 12 formed in the front portion of each of the lugs 15.

An arm 20 includes a front portion pivotally coupled to the seat 10 at the shaft 11 and a rear portion having a board 40 secured thereto and movable toward the base 41, a rod 22 rotatably supported in the rear portion of the arm 20, a block 23 fixed on the rod 22, a handle 24 fixed to the block 23, a lever 25 having one end fixed to each end of the rod 22 and rotated in concert with the rod 22 such that the levers 25 can be rotated by the handle 24, and a link 26 including one end pivotally coupled to the other end of each of the levers 25. The arm 20 includes a pair of wall members each having a guide surface 21 formed in the front and lower portion thereof, a post 28 secured to the front end thereof and is engageable with the recesses 12 of the lugs 15 so as to limit the rotational movement of the arm 20. A U-shaped bracket 27 includes an upper portion pivotally coupled to the front portion of the arm 20 at an axle 271 and includes a pair of legs 272 each having an oblong hole 270 formed in the lower portion thereof. The other ends of the links 26 are pivotally coupled to the middle portion of the respective legs 272 of the bracket 27 so that the legs 272 of the bracket 27 can be caused to rotate about the axle 271 by the handle 24.

A stick 30 pin is fixed in the front and lower portion of the seat 10, a stop 31 is rotatably engaged on the stick 30 and includes a disc 33 and a column 32 formed thereon, a pole 37 includes two end portions slidably engaged in the oblong holes 270 of the legs 272 of the bracket 27, a stop 350 is rotatably engaged on the pole 37 and includes a disc 35 and a sleeve 34 formed thereon, the sleeve 34 is slidably engaged on the column 32 of the stop 31, and a spring 36 is biased between the discs 33 and 35 for biasing the stops 31, 350 to engage with the stick 30 and the pole 37 respectively. A pair of rollers 38 are rotatably engaged on the pole 37 and located beside the stop 350 for sliding engagement with the guide surfaces 21 of the arm 20.

Figure 3:
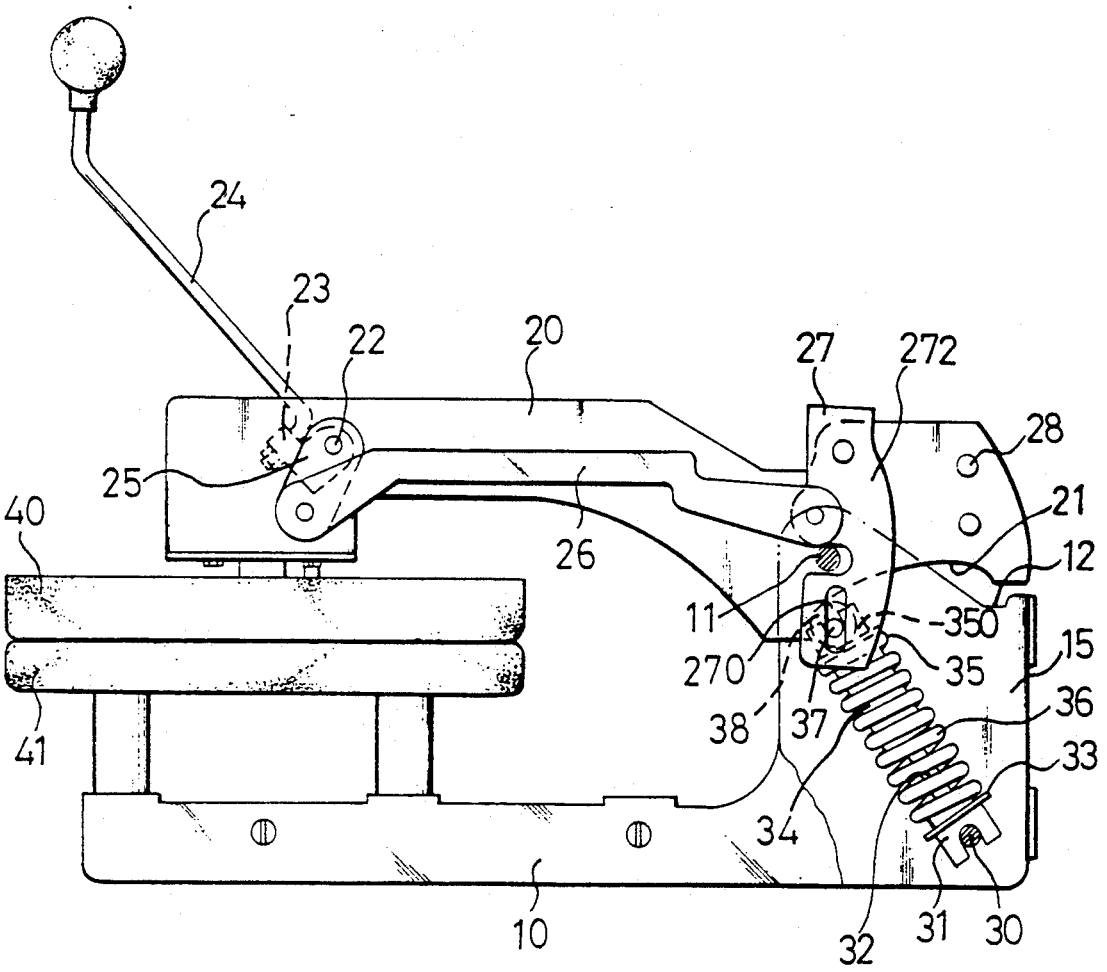
FIGS. 3 and 4 are plane views illustrating the operations of the ironing device.
Figure 4:
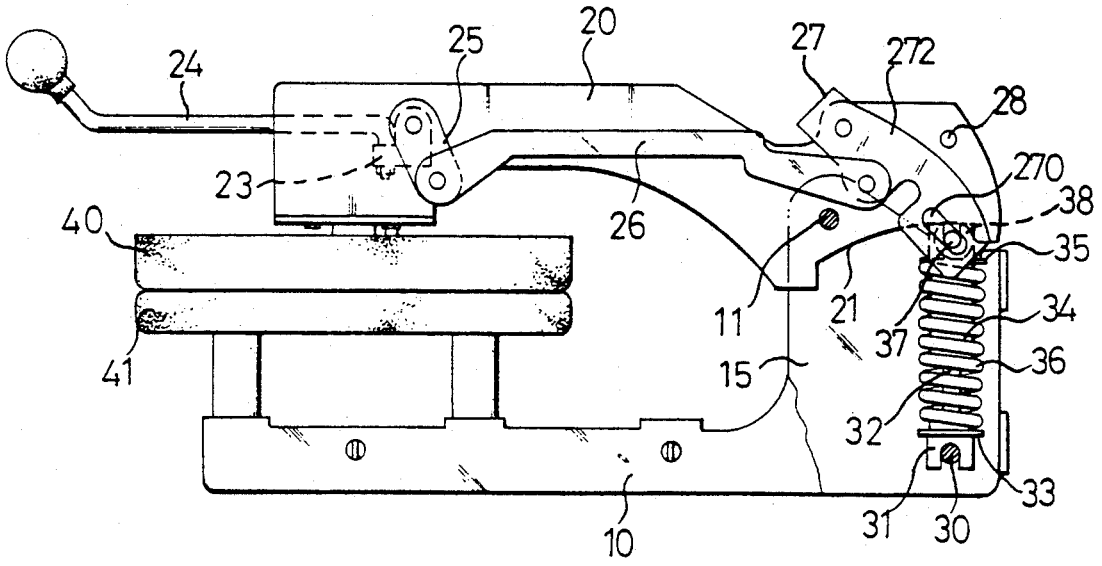

In operation, please refer to FIG. 2, clothes to be ironed is placed on the base 41, the arm 20 is rotated upward by the spring 36. The arm 20 is then rotated downward until the board 40 is engaged with the base 41, as shown in FIG. 3, such that the clothes can be pressed between the base 41 and the board 40. The handle 24 is then rotated to the position as shown in FIGS. 1 and 4, at this moment, the legs 272 of the bracket 27 are caused to move forward, the pole 37 is also caused to move forward, the rollers 38 rotate along the guide surfaces 21 of the arm 20 such that the spring 36 exerts an upward force to the front portion of the arm 20 and such that the board 40 can be forced against the base 41. The board 40 may include a heating device or a steaming device (not shown) provided therein in order that the clothes can be hot-pressed between the base 41 and the board 40.

Accordingly, the clothes can be easily hot-pressed by the ironing device in accordance with the present invention.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An ironing device comprising a seat including a front portion having a shaft a pin and a first stop provided therein and a rear portion having a base provided thereon, said first stop being rotably engaged on said pin, a handle connected to said seat, and being movable toward said base, and arm including a front portion pivotally coupled to said seat at said shaft and a rear portion having a board provided thereon and movable toward said base, a bracket including an upper and pivotally coupled to said front portion of said arm and including a middle portion and a lower end which has a pole supported therein and a second stop engaged on said pole, a coupling means coupling said handle to said middle portion of said bracket in a manner that a movement of said handle toward said base will cause said lower end of said bracket to be moved forward, and a biasing means biased between said second stop of said lower end of said bracket and said first stop engaged on said pin of said base of said seat, when said handle is moved toward said base, and, thus, said lower end of said bracket is moved forward by said movement of said handle via said coupling means, said biasing means exerting an upward force to said front portion of said arm, whereby, said board is forced against said base.

2. An ironing device according to claim 1, wherein said coupling means includes a rod rotatably supported in said rear portion of said arm and including two ends extended laterally outward of said arm, a lever including a first end fixed to each of said ends of said rod and a second end, and a link coupled between said second end of each of said levers and said middle portion of said bracket.

3. An ironing device according to claim 1, wherein said bracket includes two legs each having an oblong hole formed in a lower end thereof, said pole includes two ends slidably engaged in said oblong holes of said legs.

4. An ironing device according to claim 3, wherein said arm includes a guide surface formed in a lower portion of said front portion thereof, and said pole includes at least one roller rotatably engaged thereon and engaged with said guide surface of said arm.

5. An ironing device according to claim 1, wherein said first stop includes a first disc and a column formed thereon, said second stop includes a sleeve and a second disc formed thereon, said sleeve is slidably engaged on said column, and said biasing means is biased between said first disc and said second disc.

* * * * *